US006639558B2

(12) United States Patent
Kellerman et al.

(10) Patent No.: US 6,639,558 B2
(45) Date of Patent: Oct. 28, 2003

(54) MULTI FREQUENCY STACKED PATCH ANTENNA WITH IMPROVED FREQUENCY BAND ISOLATION

(75) Inventors: Francis William Kellerman, Brentwood, NH (US); Thomas Lee Goodwin, Dracut, MA (US)

(73) Assignee: Tyco Electronics Corp., Middletown, PA (US)

( * ) Notice: Subject to any disclaimer, the term of this patent is extended or adjusted under 35 U.S.C. 154(b) by 0 days.

(21) Appl. No.: 10/068,032

(22) Filed: Feb. 6, 2002

(65) Prior Publication Data

US 2003/0146872 A1 Aug. 7, 2003

(51) Int. Cl.[7] ..... H01Q 1/38
(52) U.S. Cl. ..... 343/700 MS; 343/846
(58) Field of Search ..... 343/700 MS, 830, 343/853, 829, 846, 848; H01Q 1/38

(56) References Cited

U.S. PATENT DOCUMENTS

| | | | | |
|---|---|---|---|---|
| 4,131,893 A | | 12/1978 | Munson et al. | 343/700 |
| 4,218,682 A | | 8/1980 | Yu | 343/700 |
| 5,121,127 A | * | 6/1992 | Toriyama | 343/700 MS |
| 5,153,600 A | * | 10/1992 | Metzler et al. | 343/700 MS |
| 5,307,075 A | * | 4/1994 | Huynh | 343/700 MS |
| 5,940,037 A | * | 8/1999 | Kellerman et al. | 343/700 MS |
| 6,118,406 A | * | 9/2000 | Josypenko | 343/700 MS |

FOREIGN PATENT DOCUMENTS

| | | | |
|---|---|---|---|
| EP | 362 079 A2 | 4/1990 | H01Q/9/04 |
| EP | 521 384 A1 | 1/1993 | H01Q/5/00 |
| EP | 0 871 238 A2 | 10/1998 | H01Q/9/04 |
| WO | WO 98/49748 | 11/1998 | H01Q/9/04 |

OTHER PUBLICATIONS

Sanad, M. et al. "A Compact Dual–Band Microstrip Antenna For Portable GPS/Cellular Phones" Jul. 11–16, 1999, pp. 116–119.

* cited by examiner

*Primary Examiner*—Hoanganh Le

(57) ABSTRACT

The invention is a stacked patch antenna having a plurality of patch antennas having respective operating frequency bands arranged in a stack, each antenna comprising a radiating conductive patch and a first cable comprising a plurality of coaxial conductors separated from each other by dielectric. A first conductor of the first cable carries the feed signal for the uppermost antenna and is conductively coupled to a null point of the radiating conductive patch of the uppermost antenna and passes through apertures at the null points of the other ones of the antennas in the stack. Each of the successively lower antennas in the stack is coupled to another one of the plurality of conductors of the cable, which conductors reference the other patches to ground. With this arrangement, high isolation is maintained between the frequency operating bands. Another antenna can be added between each consecutive pair of antennas discussed above, these antennas being fed by the same feed conductor as the antenna above it by parasitic coupling with the antenna above it.

24 Claims, 6 Drawing Sheets

MULTI FREQUENCY STACKED PATCH ANTENNA WITH IMPROVED FREQUENCY BAND ISOLATION

FIELD OF THE INVENTION

The invention pertains to stacked patch antennas. More particularly, the invention pertains to stacked patch antennas with improved frequency band isolation and multiple (greater than two) frequency bands of operation.

BACKGROUND OF THE INVENTION

A patch antenna is a type of antenna that is particularly suitable for relatively narrow band operation. A patch antenna usually comprises a dielectric panel with conductive patterns or patches deposited on both sides of the dielectric panel. The top conductive pattern or patch is the radiator and is sized and shaped to resonate at a particular frequency. This top patch (hereinafter termed the radiating patch of the patch antenna) acts as a parallel plane, micro strip transmission line serving as an antenna by giving in-phase linearly or circularly polarized radiation. The radiating patch is fed, for example, by a coaxial feed. A coaxial feed comprises a central conductor encircled concentrically by a dielectric, with the dielectric encircled concentrically by another, outer conductor serving as a shield. The outer conductor typically is connected to a ground plane. The inner conductor is connected to the radiating patch. The signal, whether transmitted from the antenna or received by the antenna, travels as a voltage differential between the inner conductor and the outer, grounded conductor. The radiating patch radiates the signal from its edges. The bottom conductive pattern acts as a ground plane for the radiating patch and is hereinafter termed the ground patch of the patch antenna.

One of the fundamental advantages of patch antennas is that they are extremely compact. However, they usually radiate efficiently over only a fairly narrow bandwidth. Accordingly, they are most commonly used in narrow bandwidth applications, such as GPS (global positioning satellite) systems, which operates over one or two very narrow frequency bands.

Particularly, the GPS system operates in two distinct bandwidths, a military band at 1227 MHZ and a civilian band at 1575 MHZ. GPS receivers that are allowed to access the military bandwidth (and thus operate with much higher accuracy) actually access the signals on both bandwidths. Accordingly, such systems would require two patch antennas, each designed to resonate in one of the two frequency bands.

In the past, a known method of feeding the radiating patch is to connect the inner conductor of the coaxial feed to the patch at a natural feed point of the patch. The natural feed point of the radiating patch is the point at which it presents an apparent fifty ohm impedance when a conductor is coupled at that point. This locus of points typically is offset from the geometric center of the radiating patch.

Stacked patch antennas are known in which two patch antennas are stacked on top of each other. For sake of clarity, the following terminology will be used hereinafter in this specification. The individual antennas in a stacked patched antenna assembly will be referred to as patch antennas or simply antennas. The top conductive pattern of a patch antenna will be termed the radiating patch of the patch antenna and the bottom conductive pattern, if included, will be termed the ground patch of the patch antenna. The entire stacked patch antenna assembly comprising multiple patch antennas will be referred to as a stacked patch antenna assembly.

A stacked patch antenna assembly is suitable for the aforementioned two band GPS type application. Conventional stacked patch antenna assemblies typically have used one of two types of feed arrangements. In one arrangement, only one patch antenna is directly fed while the other is parasitically coupled to the first patch antenna. In the other type of feed arrangement, each patch antenna is directly fed. In the type of feed arrangement where each patch antenna is directly fed, each feed, which comprises a coaxial cable with an inner and an outer conductor, has the outer conductor shorted to the ground patch at some non-centered point on the patch antenna.

In both of these types of feed arrangements, the amounts of isolation achievable between the operating frequencies of the two (or more) patch antennas is quite limited. In the former type, in which one of the patch antennas is parasitically coupled to a directly fed patch antenna, coupling between the bands is intentionally induced. In the latter case, in which each patch antenna is directly and separately fed, coupling arises from the existence of non-zero surface currents on the radiating patch of the lower patch antenna or antennas at the point or points where the outer conductor of the coaxial feed for the upper patch antenna contacts the radiating patch of the lower patch antenna. As a result, significant effort must be expended in designing circuit componentry to assure adequate isolation between the separate operating bands. Not only is such circuitry difficult to design, but it adds significant expense to the cost of the antenna assembly.

U.S. Pat. No. 5,940,037 owned by the same assignee as the present application, and which is incorporated fully herein by reference, discloses a stacked patch antenna assembly with improved frequency band isolation. Particularly, that patent discloses an exemplary stacked patch antenna assembly in which two patch antennas are fed by separate conductors. A coaxial feed for the upper patch antenna runs through an aperture in the lower patch antenna that is coincident with the null point of the lower patch antenna. The inner conductor electrically couples to the null point of the radiating patch of the uppermost patch antenna. Preferably, the outer conductor of the coaxial feed cable for the upper patch antenna is electrically connected to both the ground plane and the lower patch antenna. The outer conductor of the coaxial feed presents to the radiating patch of the upper antenna an inductance to ground referenced at a ground plane. The lower patch antenna is fed by a separate coaxial conductor that is coupled to a natural feed point of the radiating patch of the lower patch antenna.

With the ever increasing number of mobile communication services available to individuals the number of separate electronic communication devices (either hand held or for use in a motor vehicle) that a person or vehicle must carry is becoming problematic. Such services and devices include cellular telephones, wireless personal digital assistants (PDAs), GPS receivers and pagers. Accordingly, there is a push to integrate electronic communication devices into fewer separate hardware components. Inherent in this trend is a desire to integrate more and more antennas that operate in different frequency bands into an integral antenna assembly that is reasonably compact and effective.

Accordingly, it is an object of the present invention to provide an improved stacked patch antenna assembly.

It is another object of the present invention to provide a stacked patch antenna assembly with improved frequency band isolation.

It is a further object of the present invention to provide a stacked patch antenna assembly with pattern diversity.

SUMMARY OF THE INVENTION

The invention is a multiple stacked patch antenna assembly in which the number of possible patch antennas is theoretically unlimited and which provides excellent isolation between the frequency bands. In an exemplary antenna assembly with four antennas, four patch antennas are stacked above a ground plane with the radiating patch of each patch antenna (other than the uppermost antenna) serving a secondary purpose of acting as a ground plane for the patch antenna above it. The aforementioned ground plane serves as the ground plane of the lowest antenna in the stack. A single coaxial cable feeds the two uppermost patch antennas, with the radiating patch of the uppermost patch antenna coupled at its null point to the inner conductor. The upper antenna also may contain an etched transmission line to obtain the "natural feed point," if other than annular radiation is desired, as discussed in further detail below. The radiating patch of the second uppermost patch antenna is parasitically coupled through the uppermost patch antenna to the feed. The inner conductor of this feed passes through an aperture in the second uppermost patch antenna without making electrical contact therewith. The outer conductor of this feed is coupled to a ground plane and passes through apertures in the third and/or fourth uppermost patch antennas (the two lowest patch antennas). The outer conductor is electrically coupled to one or both of the two lower patch antennas. The apertures in the three lower antennas through which the inner conductor passes are all at null points of the radiating patches.

The outer conductor is grounded to the ground plane. The inner conductor passes through the lowermost patch antenna without electrically contacting it and is electrically connected to a fifty ohm point of the radiating patch of the patch antenna of the second lowest patch antenna. The two lower patch antennas are fed by a separate feed conductor. The upper of the two lower patch antennas (i.e., the second lowest patch antenna) is electrically coupled to the separate feed conductor, while the lowest patch antenna is inductively coupled to the separate feed conductor through the second lowest patch antenna.

The patch antennas preferably are arranged in descending order according to their operating frequency with the highest frequency antenna at the top of the stack and the lowest frequency antenna at the bottom of the stack. Accordingly, each successive patch antenna is larger than the one above it, making it more suitable as a ground plane for the antenna above it.

DETAILED DESCRIPTION OF THE INVENTION

One of the key concepts upon which the invention of aforementioned U.S. Pat. No. 5,940,037 relies is that the radiating patch of a patch antenna typically has a natural null point (actually a small area of the patch) somewhere within the patch at which there are no surface currents when the antenna is radiating. In the case of antennas with symmetrically shaped radiating patches, such as square or circular patches, the natural null point is at the geometric center of the square or circle. Shorting the outer conductor of the coaxial feed to a patch antenna at the null point of the radiating patch of a lower antenna minimizes any signal coupling between the two antennas.

The present specification builds upon and extends the concepts of this patent and can be applied to a stacked patch antenna assembly having any number of stacked patch antennas.

Figure 1:
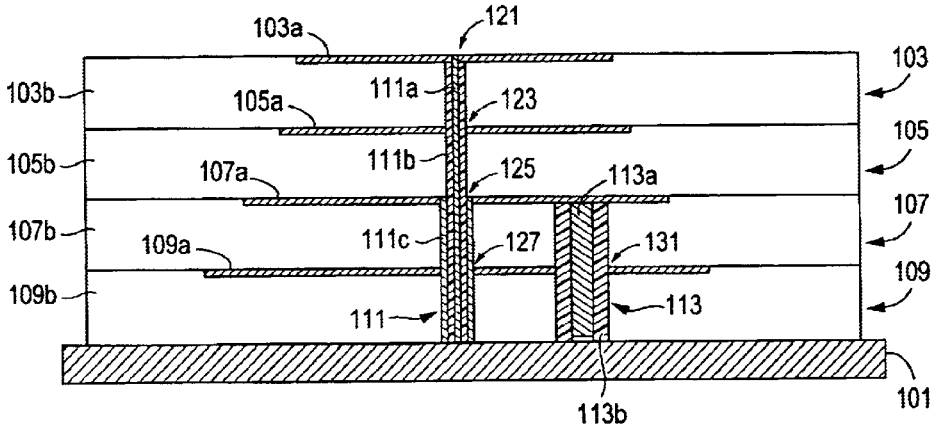
FIG. 1 is a simplified cross-sectional side view of a four layer stacked patch antenna assembly in accordance with the present invention.

Referring now to FIG. 1, which is a simplified cross-sectional side view of an exemplary four layer stacked patch antenna assembly in accordance with the present invention, the exemplary antenna assembly comprises four patch antennas 103, 105, 107, and 109 positioned above a ground plane 101. Cellular telephones are now being developed or marketed that have GPS capabilities. Accordingly, as a specific example, let us consider an antenna assembly in which the four operating frequencies are the L1 frequency for GPS (1575 MHZ), the L2 frequency for GPS (1227 MHZ), a cellular telephone band centered at 1900 MHZ, and an ISM (Industrial, Scientific and Medical) band at 2400 MHZ.

The ground plane 101 may form an integral part of the stacked patch antenna assembly. However, commonly, the ground plane 101 is provided by a conductive part of a motor vehicle or other device upon which the antenna assembly is mounted. Each antenna comprises an upper, radiating metalization (radiating patch), e.g., 109*a*, on the surface of a dielectric panel, e.g., 109*b*. The radiating patch may be of any shape desired, but typically would be in the form of a flat rectangular or circular metal micro strip or patch. Another conductive layer, e.g., ground patch 109*c*, can be provided on the bottom of the dielectric panel. However, since, in the stacked design of the present invention, each patch antenna 103, 105, 107, and 109 sits directly on top of another patch antenna (or the ground plane 101 in the case of the lowest patch antenna) 109, the bottom metalization may be eliminated since each radiating patch 105*a*, 107*a*, 109*a* can serve as the ground plane for the patch antenna, 103, 105, 107, respectively, that is immediately above it, thus eliminating the need for the bottom metalization on each antenna.

The frequency at which a patch antenna resonates is strongly influenced by the size of the radiating patch 103*a*, 105*a*, 107*a*, and 109*a*. Generally, the smaller the metalization, the higher the frequency at which the patch resonates. As noted, each patch antenna may serve as the ground plane for the patch antenna above it. Accordingly, the patch antennas should be arranged with each antenna having a radiating patch larger than the one above it, so that it can more effectively serve as a ground plane for the next higher patch antenna. Accordingly, the patch antenna with the highest frequency band, e.g., the 2400 MHZ cellular band, should be on top, the 1900 MHZ cellular band antenna should be next, followed by the 1575 MHZ GPS band antenna and the 1227 MHZ GPS band antenna on the bottom. The actual ground plane 101 serves as the ground plane for the lowermost patch antenna 103.

A two conductor coaxial cable 111 is electrically coupled to and extends upwardly from the ground plane. Coaxial cable 111 comprises an inner conductor 111*a*, an outer conductor 111*c* coaxial with and circumscribing the inner conductor 111*a*, and a dielectric layer 111*b* between the two conductors 111*a* and 111*c*. The radiating patch 103*a* of the uppermost antenna 103 is directly coupled to and fed by inner conductor 111*a* at the null point of the radiating patch 103*a*. As previously noted, in a generally square or circular patch, the null point is at the geometric center of the patch.

The second uppermost antenna 105 is not directly coupled to any conductor, but is parasitically fed by the same conductor 111*a* as the uppermost antenna 103. The inner conductor 111*a* of the coaxial cable 111 passes through an aperture 123 through the null point of antenna 105. Antenna 105 is parasitically coupled to the feed line 111*a* through the uppermost radiating patch 103*a*. Alternately, however, it could be directly fed by inner conductor 111*a* via a resonant circuit.

The inner conductor 111*a* also passes through vertical apertures 125 and 127 in the lower antennas 107 and 109, respectively, the apertures being positioned to coincide with the null points of those antennas also. FIG. 1 shows the dielectric layer 111*b* as continuous up to the uppermost patch antenna 103. However, this is not necessary as long as the inner conductor 111*a* does not directly electrically contact the radiating patches of any of the antennas other than antenna 103.

The outer conductor 111*c* is coaxial with the inner conductor 111*a* and also passes through the vertical apertures 125 and 127 at the null points of the lower two patch antennas 107 and 109. Outer conductor 111*c*, however, electrically contacts one or both of the radiating patches 107*a* and 109*a* of antennas 107 and 109, thus referencing one or both of these antennas to the ground plane 101. Accordingly, any signals on the inner and outer conductors 111*a* and 111*c* will have no substantial effect on lower patch antennas 107 and 109 since they are inductively referenced to the ground plane 101 at their null points through the outer conductor 111*c*. Hence, the lower two antennas 107, 109 are well isolated from the two upper antennas.

In this particular exemplary embodiment, in which the upper two patch antennas are for cellular telephone use, the radiation pattern of the upper two radiating patches 103*a* and 105*a* are designed to provide annular mode radiation patterns in which radiation is greatest in the plane of the patch antenna (reference FIG. 8). Particularly, the cell towers base stations with which the two uppermost cellular band antennas are to communicate typically will be displaced from the antenna primarily horizontally since the cellular base station antennas are land-based and therefore, at most, only a few hundred feet above the ground. However, the cellular telephone can be up to several miles away from the tower horizontally. Accordingly, for the cellular communication bands of antennas 103 and 105, an omni-directional annular mode pattern is desired with a null perpendicular to the plane of the antennas and a peak in the plane of the antennas.

If, on the other hand, normal mode operation is preferred, it can be provided by incorporating a transmission line section into the radiating patches 103*a* and 105*a* as discussed in aforementioned U.S. Pat. No. 5,940,037. Particularly, a micro strip line section can effectively move the feed point to its normal mode location and also provide a means for impedance matching. The primary difficulty in producing omni-directional patterns concerns impedance matching. With the coaxial conductor attached to the center of the radiating patch, the patch presents a highly capacitive termination. Turning now to the two lower patch antennas 107 and 109, they are inductively coupled to the ground plane 101 at their null points through the outer conductor 111*c* of the coaxial cable 111, as previously noted. They are fed by a separate cable 113. Cable 113 may comprise a single conductor only. Preferably, however, it is a coaxial cable comprising an inner conductor 113*a*, an outer conductor 111*c* and an insulator 111*b* there between. Conductor 113*a* is not coupled to the ground plane 101. Conductor 113*a* electrically contacts radiating patch 107*a* of patch antenna 107 at its natural 50 ohm feed point. The outer conductor 111*c* electrically contacts ground plane 101. Cable 113 passes through lower patch antenna 109 through a vertical aperture 131 without electrically contacting radiating patch 109*a*. Instead, it is capacitively fed by feed cable 113 through the patch antenna 107*a* of patch antenna 107. However, like antenna 105, patch 109*a* may be fed directly by conductor 113*a* through a resonant circuit.

In contrast to the cellular band antennas discussed above, normal mode operation is preferable for the GPS band antennas because the GPS system communicates with satellites orbiting the earth, the displacement of which relative to the antenna is substantially in the vertical direction. In normal mode operation, the main mode is perpendicular to the plane of the antennas and rolls off in the plane of the antennas, as discussed in more detail in connection with FIGS. 5A, 5B, 6A and 6B. Feeding the GPS antennas at their 50 ohm points will provide normal mode operation.

This arrangement provides for coupled operation for the two cellular communication bands and coupled operation for the two GPS bands while maintaining high isolation between the cellular communication bands on the one hand and the GPS bands on the other hand.

Described above was an exemplary embodiment comprising four patch antennas. However, additional patch antennas may be added singly or in pairs for each additional coaxial conductor added to the feed cable for the uppermost patch antenna. That is, if the feed for the uppermost patch antenna is provided by a triaxial cable, then up to six patch antennas can be stacked in accordance with the present invention. If the feed for the uppermost patch antenna is provided by a quadaxial cable, then up to eight stacked patch antennas can be provided.

Figure 2:
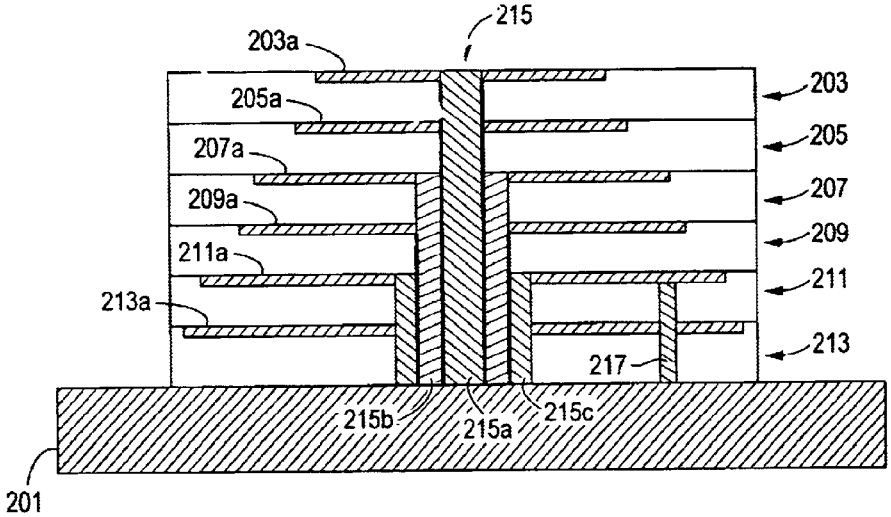
FIG. 2 is a simplified cross-sectional side view of a six layer stacked patch antenna assembly in accordance with the present invention.

FIG. 2 is an example of a six antenna stacked patch antenna assembly in accordance with the present invention. This is accomplished by adding two more patch antennas to the stack, making the center cable that feeds the uppermost antennas a triaxial cable and adding another, offset feed cable to feed the two additional antennas. As shown in FIG. 2, in this embodiment, the center cable 215 is a triaxial cable including central conductor 215*a*, middle conductor 215*b* circumscribing central conductor 215*a*, and outer conductor 215*c* circumscribing conductors 215*a* and 215*b*. In FIG. 2, the dielectric layers between the conductors 215*a*, 215*b* and 215*c* are not shown for sake of simplicity. The uppermost patch antenna 203 is directly electrically coupled to the inner conductor 215*a*, which carries the feed signals for the two uppermost patch antennas. The inner conductor passes through the remaining patch antennas 205, 207, 209, 211, and 213 without electrically contacting them. The second patch antenna 205 is parasitically coupled to the feed signals on conductor 215*a* through radiating patch 203*a* of antenna 203. Alternately, however, it could be directly coupled to feed conductor 215*a* via a resonant circuit. Even further, if only five bands of operation are necessary, patch antenna 205 can be entirely omitted. In fact, any one or more of patch antennas 205, 209 or 213 could be omitted, if desired.

Coaxial conductor 215*b* is electrically coupled to one or both of radiating patch 207*a* and 209*a* at their null points, inductively referencing them to the ground plane 217 and thus providing good frequency isolation between radiating patches 203*a* and 205*a*,on the one hand, and radiating patches 207*a* and 209*a*, on the other hand. Specifically, as discussed in aforementioned U.S. Pat. No. 5,940,037, secondary excitations tend to reform before being radiated at the normal mode when a radiating patch, such as patch 203*a* of the uppermost antenna 203, is fed at the null point. The null point feed connection electrically isolates the operating frequency band of the patch from electrical influences of secondary excitations transmitted on the coaxial feed.

Even further, outermost coaxial conductor 215*c* is directly electrically coupled to one or both of radiating patches 211*a* and 213*a* at their null points, thus inductively referencing those antennas to the ground plane 213. Accordingly, excellent frequency band isolation is provided between each consecutive pair of patch antennas by inductively coupling each consecutive pair of patch antennas to ground at their null points through different conductors.

Patch antenna 211 is directly coupled to separate feed 217 at its natural feed point and underlying patch antenna 213 is parasitically coupled to feed 217 through the overlying patch antenna 211. Middle coaxial conductor 215*b* serves double duty as the feed conductor for the middle two patch antennas 207 and 209 while still referencing those antennas to ground, thus providing a ground reference for the upper two patch antennas 203 and 205. Note that a third cable should not be brought up in a separate location to feed the middle two patch antennas 207 and 209. A separate, displaced conductor should be employed only for the two lowermost patch antennas in the stacked patch antenna assembly because that conductor, e.g., conductor 217 in FIG. 2, does not need to pass through any other antennas. If a separate, displaced conductor were brought up to feed any middle patch antennas, e.g., antennas 207 and 209 in FIG. 2 in the manner of separate feed 217 for the lower two antennas 211, 213, it would have to pass through the lower two patch antennas 211 and 213 at locations other than the null points of those antennas. Such an arrangement, of course, would defeat one of the purposes of the present invention, namely, excellent isolation between the pairs of patch antennas. Also note that the lowermost antenna or antenna pair 211 and/or 213 should be fed by a separate, displaced conductor, e.g., conductor 217. The outermost conductor 215*c* of the central cable 215 should not be used to serve double duty as the feed for the lowermost antenna(s) 211 and/or 213 as well as a ground reference for the overlying antenna(s) in the stack, e.g., antennas 207 and/or 209. Conductor 215*c* should not be used as the feed for the lower antenna(s) 211, 213 because it is at ground potential.

The number of stacked patch antennas that can be combined in an integral stacked patch antenna assembly in accordance with the present invention is limited only by practical considerations such as the thickness of the outermost conductor of the coaxial feed cable for the uppermost antennas. Particularly, as the number of coaxial conductors surrounding the central feed conductor increases, the diameter of the cable increases. Accordingly, the aperture in the lowermost patch antennas, through which the most coaxial conductors must pass, will eventually need to be larger than the boundaries of the null area of the lowermost antennas.

Figure 3:
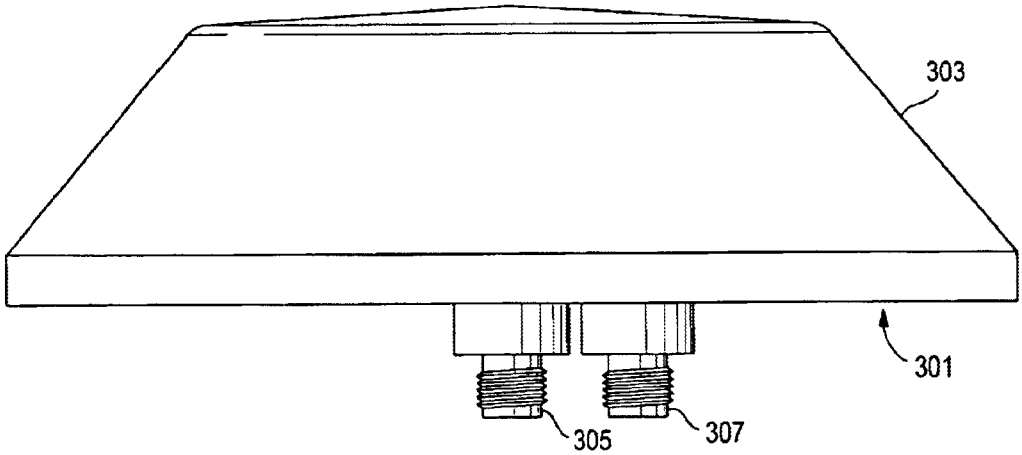
FIG. 3 is a perspective view of a stacked patch antenna assembly in accordance with the present invention.
Figure 4:
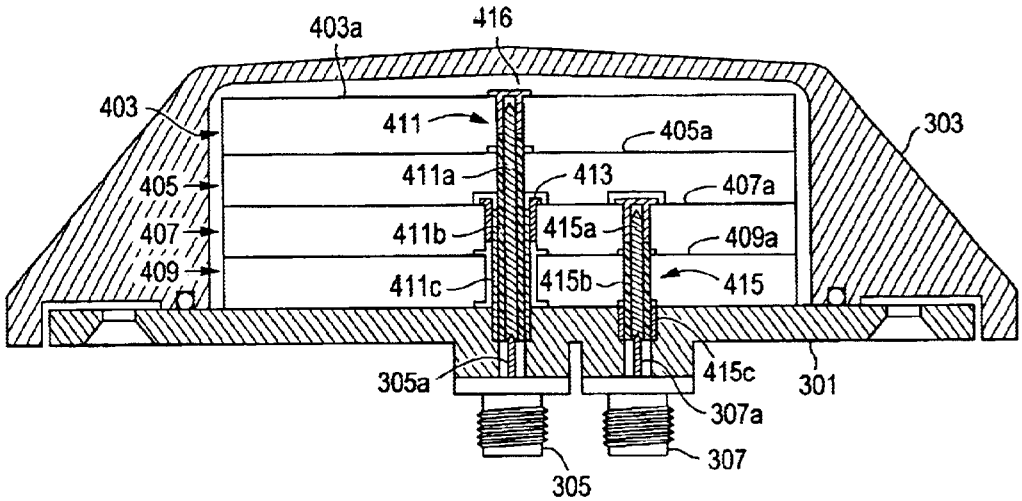
FIG. 4 is a detailed cross-sectional side view of a four layer stacked patch antenna assembly in accordance with the present invention.

FIG. 3 is a perspective view of a practical embodiment of a four antenna stacked patch antenna assembly 300 such as illustrated in simplified view in FIG. 1. FIG. 4 is a cross-sectional side view of the same antenna assembly. The antenna assembly components as discussed above in connection with FIG. 1, for example, are contained within a housing comprising a conducting base 301 and a radome 303. The conductive base 301 nests within the bottom of the radome 303. Protruding from the base are two coaxial connectors 305, 307 that provide a feedthrough connection to the patch antennas (see FIG. 4). Signals are passed between each antenna and transmitting circuitry external of the antenna (not shown) through coaxial cables (also not shown) coupled to coaxial connectors 305 and 307.

Referring specifically to FIG. 4, the circuit board 401 serves as the ground plane for the patch antennas 403, 405, 407. 409. The central coaxial feed 411 for the two uppermost antennas 403, 405 is constructed from a coaxial cable. An inner conductor 411*a* extends from the electrical connector 414 to the conductive basket 416. The upper end of the inner conductor 411*a* is terminated in the conductive basket 416, which resiliently grips the inner conductor to establish an electrical connection with radiating patch 403*a* of patch antenna 403. The basket 416 comprises an electrical receptacle with spring fingers that grip the inner conductor 411*a*. The basket 416 is electrically connected to the radiating patch 403*a* by, for example, a solder joint. The lower end of the inner conductor 411*a* comprises an electrical receptacle with spring fingers that grip the inner conductor 305*a* of the electrical connector 305 to form an electrical connection. The outer conductor 411*c* extends from the ground plane through antennas 407, 409. The outer conductor is electrically connected to the base 401 by, for example, a solder joint.

The outer conductor is coupled to the two lower patch antennas 407, 409 by conducting flanged sleeve 413 (shown here only for antenna 407 for clarity). The outer conductor is electrically connected to the sleeves 413 by, for example, a solder joint. The sleeves 413 are electrically connected to the radiating patches 407*a*, 409*a* by, for example, a solder joint. A dielectric sleeve 411*b* is concentric with, and extends between, inner conductor 411*a* and outer conductor 411*c*. A second coaxial feed 415 for the two lowermost antennas 407, 409 is constructed as a coaxial cable. An inner conductor 415*a* extends from the electrical connector 418 to a conductive basket 420. The upper end of the inner conductor 415*a* is terminated in the conductive basket 420 that resiliently grips the inner conductor 415*a* to establish an electrical connection with radiating patch 407*a* of patch antenna 407. The basket 420 comprises an electrical receptacle with spring fingers that grip the inner conductor 415*a*. The basket 420 is electrically connected to the radiating patch 407*a* by, for example, a solder joint. The lower end of the inner conductor 415*a* comprises an electrical receptacle with spring fingers that grip the inner conductor 418*a* of the electrical connector 418 to form an electrical connection. The outer conductor 415*c* is electrically connected to the base 301 by, for example, a solder joint. A dielectric sleeve 415*b* is concentric with, and extends between inner conductor 415*a* and outer conductor 415*c*.

A stacked patch antenna assembly comprising four antennas in accordance with the present invention was constructed to determine the isolation parameters and other parameters of the invention. The prototype was arbitrarily designed to produce omni-directional radiation patterns for the two highest frequencies. In that prototype, the uppermost layer was a 2400 MHZ antenna with a square radiating patch 0.690 inches per side on a 0.2 inch substrate. The feed point was at the geometric center of the patch. The second uppermost patch antenna was designed to resonate at 1900 MHZ and had a square radiating patch 0.780 inches per side on a 0.18 inch thick substrate. A 0.150 inch diameter circle was removed from the center of the radiating patch to accommodate the central conductor of the feed line for the upper antennas.

The third uppermost (which is the second lowermost) patch antenna was designed to resonate at 1575 MHZ and had a square radiating patch 0.922 inches per side on a 0.18 inch thick substrate. The feed point was located 0.280 inches from the patch center line. Finally, the lowermost antenna was designed to resonate at 1227 MHZ and had a square radiating patch 1.36 inches per side on a 0.18 inch thick substrate. It had a 0.150 inch diameter circular aperture at its center to accommodate the inner and outer conductors of the central coaxial cable. Only this lowermost antenna had a ground metalization on the bottom of the dielectric substrate of the antenna. The outer conductor of a 0.085 inch coaxial cable feeding the uppermost two patch antennas was electrically connected to the center of both of the two lower patch antennas as well as to the ground plane. The outer conductor of the 1575 MHZ antenna feed was electrically connected to the ground plane.

Figure 5:
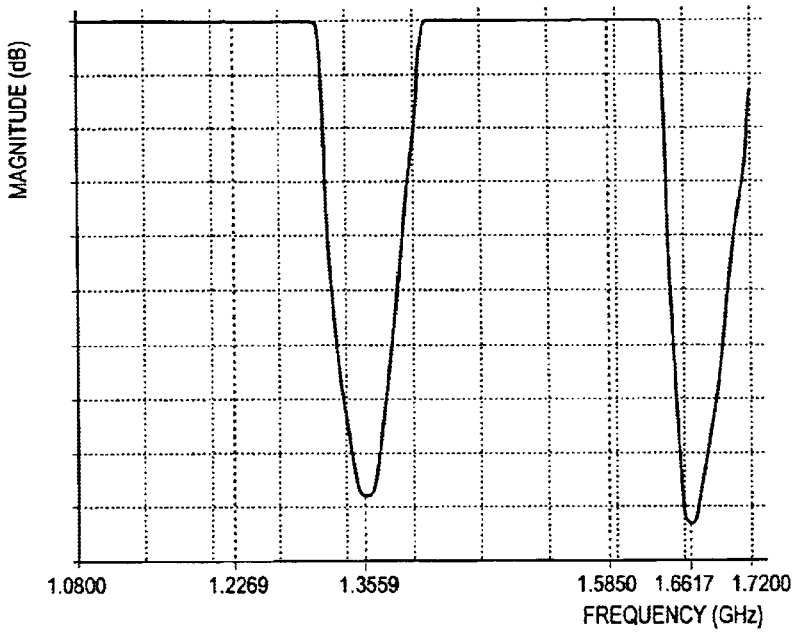
FIG. 5 is a graph showing impedance as a function of frequency for a prototype four layer stacked patch antenna assembly in accordance with the present invention for the two lower frequency bands.

The stacked patch antenna assembly was mounted on an 18 inch diameter ground plane for testing. Measured impedance results for the GPS bands are shown in FIG. 5. The measured resonance for the L2 band is higher in frequency than nominal by about 10% and the L1 band is higher by about approximately 5%. However, both of these patches were fabricated approximately 5% over-sized to allow for tuning. Accordingly, these results are in excellent agreement with expectations. In both cases, the measured 2:1 VSWR (Voltage Standing Wave Ratio) bandwidth (approximately 40 MHZ) is somewhat larger than predicted and adequate for the application.

Figure 6A:
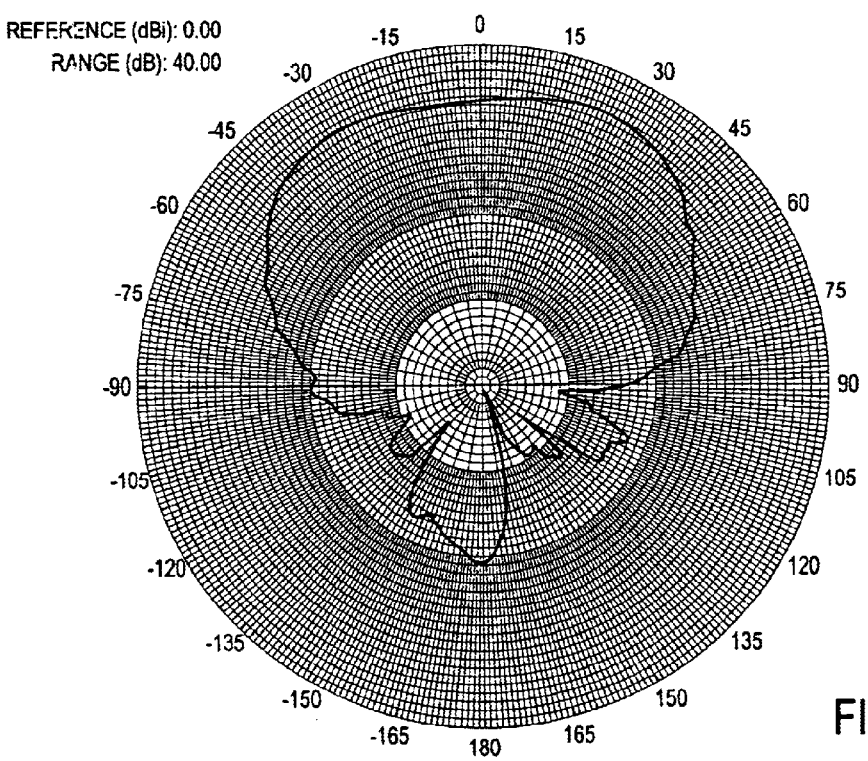
FIG. 6A is a radiation pattern diagram illustrating the elevation plane radiation pattern for the two lower patch antennas at a (Ø) of 0° in accordance with one implementation of the present invention.
Figure 6B:
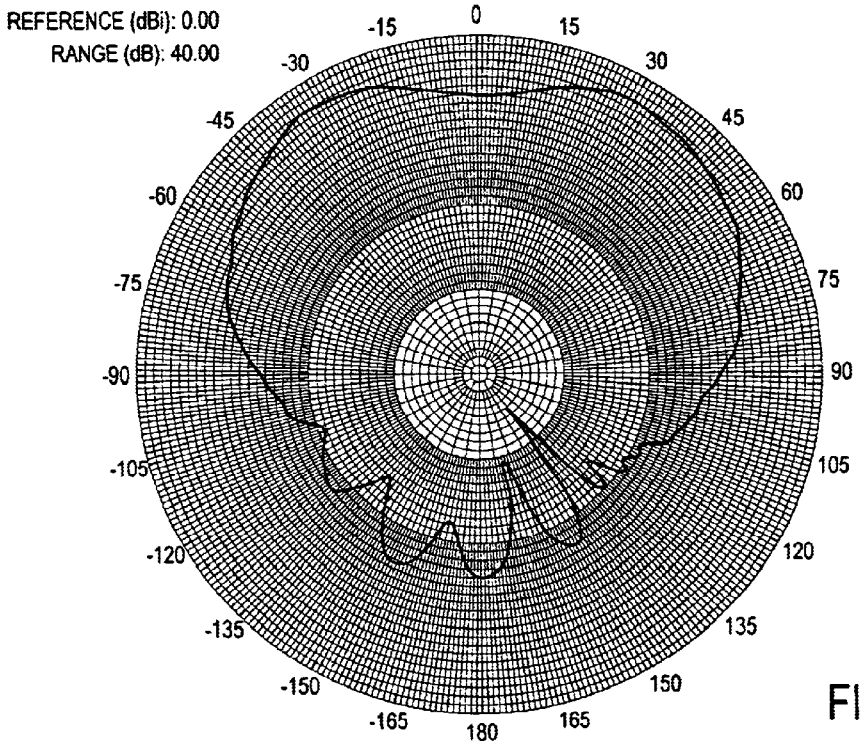
FIG. 6B is a radiation pattern diagram illustrating the elevation plane radiation pattern for the two lower patch antennas at a (Ø) of 90° in accordance with one implementation of the present invention.

FIGS. 6A and 6B show the measured radiation pattern for the L2 GPS antenna (1350 MHZ) for Ø of 0° and 90°, respectively, and are representative of normal mode patterns. The L1 patterns are similar with slightly smaller beam width. Both are in good agreement with predicted results.

Figure 7:
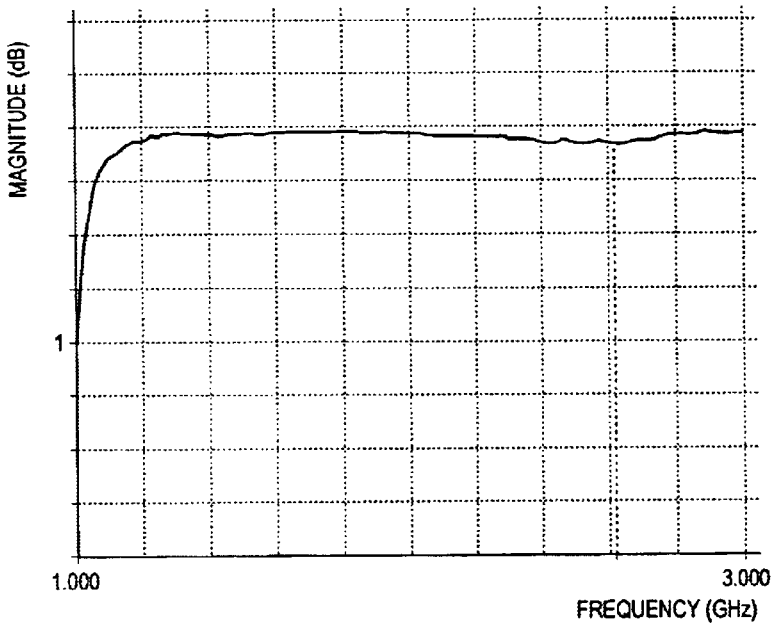
FIG. 7 is a graph showing impedance as a function of frequency of a prototype four layer stacked patch antenna assembly in accordance with the present invention for the two higher frequency bands.

As expected, initial models predicted poor impedance match for the two uppermost communication band patch antennas with the feed probe at the center of the radiating patches. Measured results that confirm the mismatch are shown in FIG. 7.

Figure 8A:
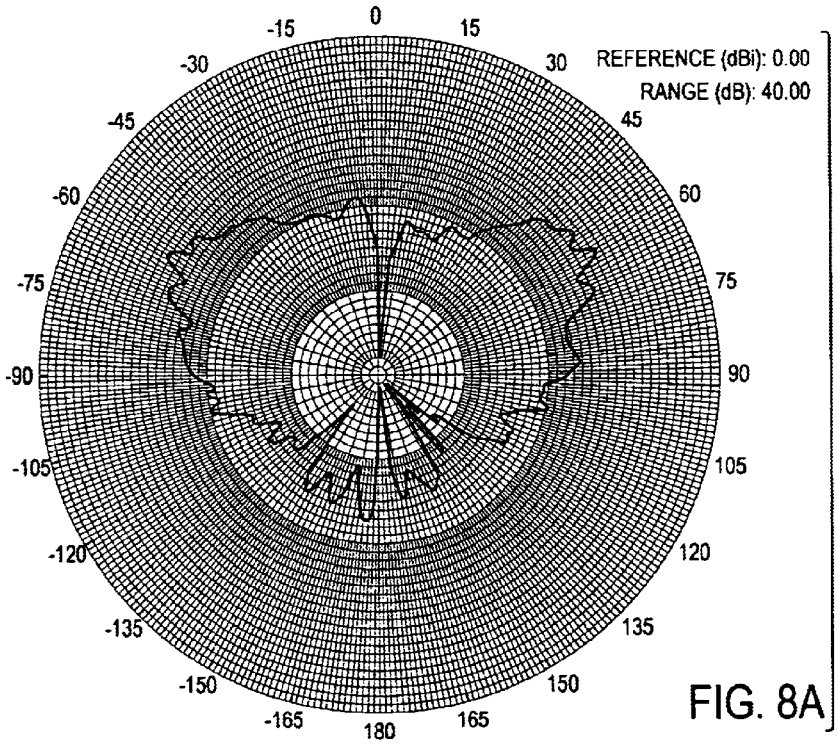
FIG. 8A is a radiation pattern diagram illustrating the elevation plane radiation pattern for the two upper patch antennas at a (Ø) of 0° in accordance with one implementation of the present invention (annular mode of radiation).
Figure 8B:
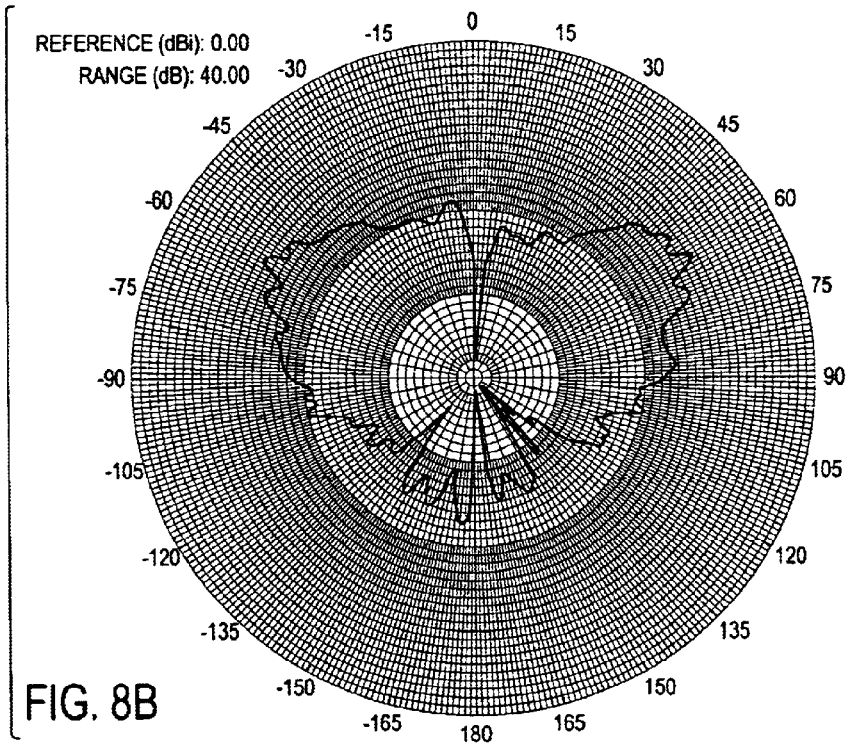
FIG. 8B is a radiation pattern diagram illustrating the elevation plane radiation pattern for the two upper patch antennas at a (Ø) of 90° in accordance with one implementation of the present invention.

FIGS. 8A and 8B are measured radiation patterns from the 2400 MHZ antenna (the uppermost antenna) for Ø of 0° and 90°, respectively. Although the gain is low due to the impedance mismatch, the desired omni-directional pattern is radiated, again confirming expected results. Radiation patterns at 1900 MHZ are similar, although there is some asymmetry and the gain is lower than at 2400 MHZ.

Figure 9:
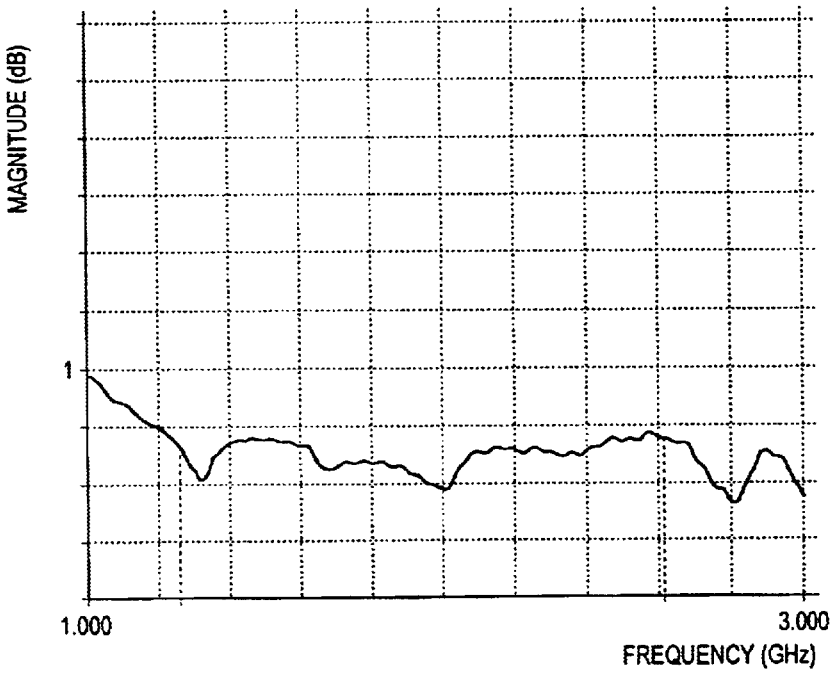
FIG. 9 is a graph showing isolation measurements between the two GPS bands of the two lower patch antennas, on the one hand, and the bands of the two cellular communication bands of the upper two antennas in accordance with one implementation of the present invention without inductive shunts.
Figure 10:
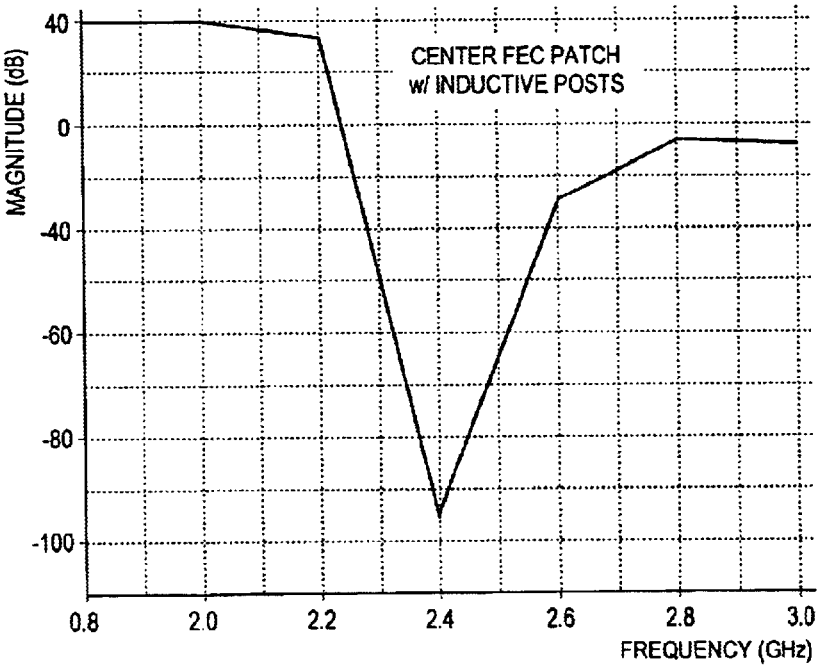
FIG. 10 is a graph showing impedance as a function of frequency for a four layer stacked a patch antenna assembly model in accordance with one implementation of the present invention after the addition of inductive shunts to counteract capacitive loading.

Isolation between the two GPS bands, on the one hand, and the cellular communication bands, on the other hand, is better than 20 dB, as illustrated in FIG. 9, which is a plot of insertion loss between the two coaxial ports as a function of frequency. In order to compensate for the capacitive loading, inductive posts were added at the edges of the uppermost patch. The posts were shorted to both the 2400 MHZ patch and the 1900 MHZ patch. Model results are shown in FIG. 10 and indicate improved impedance matching.

Having thus described a few particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

We claim:

1. A stacked patch antenna assembly comprising:

a first group of patch antennas comprising a plurality of patch antennas arranged in a stack, each said antenna having a respective operating frequency band, and each antenna comprising a radiating conductive patch;

a first cable comprising a plurality of separate, coaxial conductors;

wherein a first conductor of said first cable is conductively coupled to said radiating conductive patch of an uppermost one of said antennas and passes through apertures at null points of a plurality of other ones of said antennas, said other ones of said antennas in said stack coupled to another one of said plurality of conductors of said cable, said first conductor carrying a feed signal for said uppermost antenna; and wherein each of said plurality of patch antennas other than said uppermost antenna is fed by a different cable.

2. The stacked patch antenna assembly of claim 1 wherein said first conductor of said first cable is conductively coupled to said radiating patch of said at least one antenna at a null point of said radiating patch.

3. The stacked patch antenna assembly of claim 1 wherein said radiating patch of said uppermost antenna comprises a transmission line adapted to cause the natural feed point of said radiating patch of said uppermost antenna of said first group of antennas to exist where said first conductor of said first cable contacts said radiating patch.

4. The stacked patch antenna assembly of claim 1 wherein said different cable is conductively coupled to a lowermost one of said antennas of said first group at a natural point of its radiating conductive patch.

5. A stacked patch antenna assembly comprising:

a first group of patch antennas comprising a plurality of patch antennas arranged in a stack, each said antenna having a respective operating frequency band, and each antenna comprising a radiating conductive patch;

a first cable comprising a plurality of separate, coaxial conductors;

wherein a first conductor of said first cable is conductively coupled to said radiating conductive patch of an uppermost one of said antennas and passes through apertures at null points of the other ones of said antennas, said other ones of said antennas in said stack coupled to another one of said plurality of conductors of said cable, said first conductor carrying a feed signal for said uppermost antenna; and wherein each of said plurality of patch antennas other than said uppermost antenna is fed by a different cable;

a second group of patch antennas comprising at least one patch antenna having a radiating conductive patch, each antenna of said second group corresponding to one of said antennas of said first group and being inductively coupled to said feed conductor of said corresponding antenna of said first group through said radiating patch of said corresponding antenna of said first group.

6. The stacked patch antenna assembly of claim 5 wherein said uppermost antenna of said first group has a corresponding antenna of said second group and wherein said corresponding antenna of said second group comprises a transmission line adapted to cause the natural feed point of said radiating conductive patch of said corresponding antenna of said second group of antennas to exist where said first conductor of said first cable passes through said radiating patch.

7. The stacked patch antenna assembly of claim 5 wherein each said antenna of said first group is above each said corresponding antenna of said second group.

8. The stacked patch antenna assembly of claim 7 wherein said feed conductor for each antenna of said first group having a corresponding antenna of said second group passes through an aperture in said antenna of said second group without conductively contacting said radiating patch of said antenna of said second group.

9. The stacked patch antenna assembly of claim 8 wherein said antennas are stacked from top to bottom in descending order according to their operating frequency bands.

10. The stacked patch antenna assembly of claim 9 further comprising a ground plane beneath a lowermost one of said antennas.

11. The stacked patch antenna assembly of claim 10 further comprising a second feed cable coupled to a lowermost one of said antennas of said first group at a natural point of said lowermost one of said antennas.

12. The stacked patch antenna assembly of claim 11 wherein said lowermost antenna of said first group has a corresponding antenna of said second group and said different cable comprises a first conductor and a second conductor, said first conductor being conductively coupled to said radiating conductive patch of said lowermost antenna of said first group and passing through an aperture in said corresponding antenna of said second group without conductively contacting it.

13. The stacked patch antenna assembly of claim 11 wherein said first group of antennas comprises at least at least three antennas, including said uppermost antenna and said lowermost antenna of said first group as well at least one middle antenna and wherein said at least one middle antenna uses said other one of said conductors of said first cable to which it is coupled as a feed conductor.

14. The stacked patch antenna assembly of claim 13 wherein said first group of antennas comprises a plurality of middle antennas, each said middle antenna using a separate one of said other conductors of said first cable as a feed conductor.

15. A stacked patch antenna assembly comprising:

a first cable comprising at least first and second coaxial conductors separated from each other by a dielectric;

a first patch antenna having a first operating frequency band, said first antenna comprising a first radiating conductive patch, said patch conductively coupled to said first coaxial conductor of said first cable, said first coaxial conductor acting as a feed conductor for said first patch antenna;

a second patch antenna below said first patch antenna having a second operating frequency band, said second antenna comprising a second radiating conductive patch and having an aperture through its null point through which said first conductor of said first cable passes without conductively contacting said second radiating patch, said second antenna inductively coupled to said first conductor of said first cable through said first radiating patch of said first antenna, said first coaxial conductor also acting as a feed conductor for said second patch antenna;

a third patch antenna below said second patch antenna having a third operating frequency band, said third antenna comprising a third radiating conductive patch and having an aperture through its null point through which said first cable passes without said first conductor thereof conductively contacting said third radiating patch;

a fourth patch antenna below said third patch antenna having a fourth operating frequency band, said fourth antenna comprising a fourth radiating conductive patch and having an aperture through its null point through which said first cable passes without said first conductor thereof conductively contacting said third radiating patch;

a ground plane beneath said fourth antenna; and a second feed conductor conductively coupled to said third patch and inductively coupled to said fourth patch through said third patch, said second feed conductor carrying feed signals for said third and fourth antennas;

wherein said second coaxial conductor of said first cable is conductively coupled to said ground plane and to said null point of at least one of said third and fourth radiating patches.

16. The stacked patch antenna assembly of claim 15 wherein said first coaxial conductor of said first cable is couple to a null point of said first patch antenna.

17. The stacked patch antenna assembly of claim 15 wherein said radiating patch of said first antenna comprises a transmission line adapted to cause the natural feed point of said radiating patch of said first antenna to exist where said first conductor of said first cable contacts said radiating patch.

18. The stacked patch antenna assembly of claim 15 wherein said second antenna comprises a transmission line adapted to cause the natural feed point of said radiating patch of said second antenna to exist where said first conductor of said first cable passes through said radiating patch.

19. The stacked patch antenna assembly of claim 15 wherein said second coaxial conductor passes through an aperture in said fourth antenna without conductively contacting said fourth antenna.

20. The stacked patch antenna assembly of claim 15 wherein said second feed conductor is conductively coupled to said third radiating patch at a natural feed point of said patch.

21. The stacked patch antenna assembly of claim 15 wherein said antennas are stacked from top to bottom in descending order of their operating frequency bands.

22. The stacked patch antenna assembly of claim 21 wherein each said antenna in said stack serves as a ground plane for the antenna above it.

23. The stacked patch antenna assembly of claim 15 further comprising:

a fifth patch antenna between said second and third patch antennas having a fifth operating frequency band, said fifth antenna comprising a fifth radiating conductive patch and having an aperture through its null point through which said first coaxial conductor of said first cable passes with said second conductor out conductively contacting said fifth radiating patch;

wherein said first cable further comprises a third conductor coaxial with said first and second coaxial conductors of said first cable, said third conductor coupled to said ground plane and to said fifth patch antenna at a null point thereof, said third conductor referencing said fifth antenna to ground and serving as a feed conductor for said fifth antenna.

24. The stacked patch antenna assembly of claim 23 further comprising:

a sixth patch antenna between said third patch antenna and said fifth patch antenna having a sixth operating frequency band, said sixth antenna comprising a sixth radiating conductive patch and having an aperture through its null point through which said first and third coaxial conductors of said first cable pass without conductively contacting said third radiating patch.

* * * * *